US005680828A

United States Patent [19]

Totten

[11] Patent Number: 5,680,828

[45] Date of Patent: Oct. 28, 1997

[54] KAYAKS

[76] Inventor: Joseph J. Totten, 406 Ocean Ave., Sea Bright, N.J. 07203

[21] Appl. No.: 699,167

[22] Filed: Aug. 19, 1996

[51] Int. Cl.[6] ..... B63B 35/00

[52] U.S. Cl. ..... 114/347; 114/357

[58] Field of Search ..... 114/352–357, 65 R, 114/79 R, 80, 81, 82–88, 347, 363; D12/302

[56] References Cited

U.S. PATENT DOCUMENTS

| | | | |
|---|---|---|---|
| 250,717 | 12/1881 | Durant | 114/358 |
| 1,124,637 | 1/1915 | Miller | 114/347 |
| 1,298,042 | 3/1919 | Haskell | 114/347 |
| 1,992,711 | 2/1935 | Mead | 114/355 |
| 3,075,207 | 1/1963 | Lewis | 114/354 |
| 3,176,055 | 3/1965 | Loos | 114/357 |
| 3,529,312 | 9/1970 | Robinsky . | |
| 3,869,743 | 3/1975 | Brown et al. . | |
| 4,706,597 | 11/1987 | Figone | 114/357 |
| 4,821,666 | 4/1989 | Ingram . | |

*Primary Examiner*—Edwin L. Swinehart

[57] ABSTRACT

A novel permanent-assembly kayak is disclosed having a framework and a hard skin of dimensionally stable sheet material unified with the framework to achieve strength and mechanical stability greater than that which results from the separate effects of the hard skin and the framework. The component parts may be packaged compactly as a kit that may be shipped and stored in inventory economically; greatly elongated frame members are formed of pipe lengths and cores that are telescopically assembled, each part being short enough for compact packaging. The hard-skin material is intrinsically stiff, yet it is sufficiently yielding to be rolled up in the compact package.

23 Claims, 4 Drawing Sheets

KAYAKS

The present invention relates to kayaks, a form of canoe whose top is covered to exclude water.

BACKGROUND

Two types of kayaks are well known. Both types have a framework and sheet material that covers the framework, forming a hull and a deck. One form of kayak is collapsible; it consists of a cover of a pliant, waterproof material and a collapsible framework that is inserted into the cover or erected in the cover, when the kayak is to be used. Such kayaks are intended to be disassembled and reassembled repeatedly. The present invention is concerned with another type of kayak which, having been assembled once, remains assembled permanently.

Fixed-assembly kayaks are made of various materials, such as wood, fiberglass or a composite of graphite filaments. Their considerable bulk is a deterrant against their being stocked by a retailer; and the cost of shipping complete kayaks is high, largely because of their bulk.

Kits of parts for kayaks are available, usually of wood, for assembly by the buyer. Some parts of the kit are so large that the kit is bulky, resulting in substantial shipping expense. Moreover, comparatively few purchasers have the skills and enterprise required to produce a completed kayak from an available kit of parts. An assembled kayak of wood must be sanded and given a surface finish suitable for marine use. Kits of parts for kayaks are in limited demand; they are available on special order.

SUMMARY OF THE INVENTION

The present invention is aimed at promoting greatly increased demand for fixed-assembly kayaks. An illustrative embodiment of the novel kayak is shown in the accompanying drawings and described below in detail. The components of the illustrative kayak can be readily assembled without depending on special skills. One of its notable attributes is its availabity in the form of a compactly packaged kit of parts. A whole new channel of distribution for fixed-assembly kayaks becomes practical, because it is economical to ship and maintain inventories of the compact kits. Rather than being a special-order product, there is promise of the kits being stocked by retailers, and being readily available without resort to special-order procedures, and without suffering long delays.

As will become evident, the novel kayak incorporates attributes that contribute to its structural merit, apart from its availability as a compact packaged kit of parts.

The kit of parts for a kayak provided by the present invention does not require special skills or equipment for assembly. The components are of plastics whose finish, as produced, is both attractive and highly effective for withstanding attack in the marine environment. Consequently, there is no need for surfacing operations to complete the kayak. Moreover, the end result is a kayak whose weight is remarkably light, a trait of considerable value in kayaks, for portage and for racing.

The deck and the hull of the novel kayak are formed of sheets of plastics. That sheet material is dimensionally stable, in the sense that a square of the material has constant dimensions horizontally, vertically and diagonally. The sheet material exhibits stiffness such as to resist bending transverse to the length of the kayak. The walls of the deck and the hull are supported at successive locations along the kayak by formers that are parts of the kayak's framework.

The preferred sheet material for the deck and hull walls of the illustrative kayak is commercially available; it is sold under the trademark "Coroplast". It comprises two face sheets that are spaced apart and interconnected by parallel thin and elongated separators which are unitary with the face sheets. The sheet material resists being bent parallel to the elongated separators and it is prominently resistant to being bent transverse to its elongated separators. The result is a hard-skin kayak. The spaces between the elongated separators are hollows that contribute to the remarkable lightness and buoyancy of the kayak. Its surface is attractive and well-suited to marine use.

The pieces of sheet material that provide the wall of the deck and the wall of the hull are unified with the framework of the kayak. The result is a structure that is strong and mechanically stable, traits that are attributable to the dimensional stability of the sheet material and the framework separately, but also to the securement of the sheet material and the framework to each other.

The walls of the deck and the hull are formed of pieces of sheet material united by a distinctive joint. Marginal portions of the deck and hull walls are disposed close to each other along elongated gunwale members of the framework. A cap or clamping strip overlies and digs into marginal portions of both the hull's wall and the deck's wall; each cap or clamping strip is screwed to a respective gunwale member. That form of joint contributes prominently to the strength and mechanical stability of the thus unified hull and deck walls.

The kayak includes a "coaming", being a strong frame around an opening in the deck for withstanding stresses imposed by the kayak's occupant. The coaming is unified with the deck's sheet material by a distinctive joint that contributes to the strength of the kayak. Like the deck-to-hull joint, a cap or clamping strip overlies and digs into a marginal portion of the deck's sheet material. The clamping strip is screwed to the coaming. The shape of the coaming is fixed and the coaming is joined securely to the dimensionally stable sheet material that forms the wall of the deck; that material, in turn, is fixed to the gunwale members, respectively. Inasmuch as the sheet material of the deck is unified with both the coaming and the gunwale members, all of those parts coact to contribute mechanical strength to the kayak.

In general, two stresses develop in a kayak; they result from weight of the kayak's occupant between the front and rear portions of the kayak, reacting to the floatation of the kayak's front and rear portions. A compressive stress develops along the top of the kayak's deck, and tension develops along the bottom of the hull.

The coaming, as a large opening in the deck, ordinarily would be considered a structural weakness; such an opening ordinarily tends to reduce the capacity of the deck to withstand the longitudinal compressive stress that develops along the top of the kayak's deck. In the illustrative embodiment of the invention there are deck braces that extend from fore and aft portions of the coaming. The coaming plus the deck braces constitute a column that withstands the longitudinal compressive stress.

The framework of the illustrative kayak includes front and rear trusses; each truss comprises four members that extend lengthwise and are joined at the bow and stern of the kayak. "Formers" or transverse frames are spaced apart along each truss; each former is fixed, as by a screw, to each of the four lengthwise-extending members of the framework, i.e., the two gunwale members, a deck brace, and an inner keel member.

Dimensionally stable sheet material extends between—and is secured to—side portions of the coaming and to portions of the gunwale members opposite to sides of the coaming, and between the deck brace of each truss and both of the gunwale members. This relationship of the dimensionally stable sheet material to the kayak's framework greatly enhances the strength and structural stability of the kayak, far beyond that which could be provided by the framework alone.

A seat for the kayak's occupant is secured in place under the coaming, on a liner. The liner is a piece of sheet material resting on the bottom of the hull's wall. Inner keel members extend lengthwise from and are secured to the opposite ends of the liner. The hull includes bow and stern stems; these parts are elongated caps which contain end portions of the sheet material that forms the wall of the hull. The bow and stern ends of the inner keel members are fixed to the bow and stern stems which, in turn, are fixed to the unified bow ends of the gunwale members and to the unified stern ends of the gunwale members. A series of connected parts in the hull is thus formed, which withstands the tension developed along the bottom of the hull. The series hull structure includes the liner, the inner keel members, the bow stem and the stern stem. The wall of the hull helps in withstanding that tension.

The material that forms the wall of the hull in the illustrative embodiment of the invention is a single sheet. It has V-shaped cutouts at its forward and stern ends; fold lines cause the edges of the V-shaped cutouts to come together when the hull sheet is contoured to form the hull. There is no joint or seam anywhere in the hull's wall; seams would be prone to development of leaks.

The parts of the illustrative kayak shown in the drawings and described in detail below are readily packaged for compact shipment and storage. The sheets of material that form the walls of the deck and the hull of the illustrative kayak are elongated in the fore-and-aft direction, the same direction along which the internal elongated separators of the Coroplast sheets extend. The sheet material is rolled up for compact packaging. In being rolled up, it is forcibly curved transverse to its internal elongated separators, overcoming its stiffness; but it is sufficiently yieldable to be rolled up. The original flatness of the sheet material is readily restored when the sheet is unrolled preparatory to assembling the kayak.

The gunwale members, formed of pipes, extend all along the kayak. The pipes are subdivided into segmental lengths, to be packaged compactly. Each of the gunwale member includes a series of rod-like cores that extend, respectively, from the bore in one pipe length into the bore in the next pipe length, telescopically. The bores in the gunwale's pipe lengths are collectively occupied by the rod-like cores. The screws of the clamping strips are threaded into not only the wall of a pipe segment, but also (for greater security) into the rod-like core contained in the bore of such pipe length. The screws block all possibility of telescopic dis-assembly of the pipe lengths that comprise the gunwale members. Like the gunwale members, each deck brace and each inner keel member comprises multiple segments of pipe and rod-like cores that may be compactly packaged.

The coaming, too, is subdivided, being two parts in the illustrative kayak. The coaming is thus contained in the compact packaging of the kit of parts. Despite the division of the elongated members of the kayak's framework into segments, the segments when assembled as elongated members of the framework, in turn unified with hull sheet material and deck sheet material, constitute a sturdy, mechanically stable structure in the complete assembly of the kayak.

An illustrative embodiment of the invention is shown in the accompanying drawings and described in detail below.

DETAILED DESCRIPTION OF ILLUSTRATIVE EMBODIMENT

Figure 1:
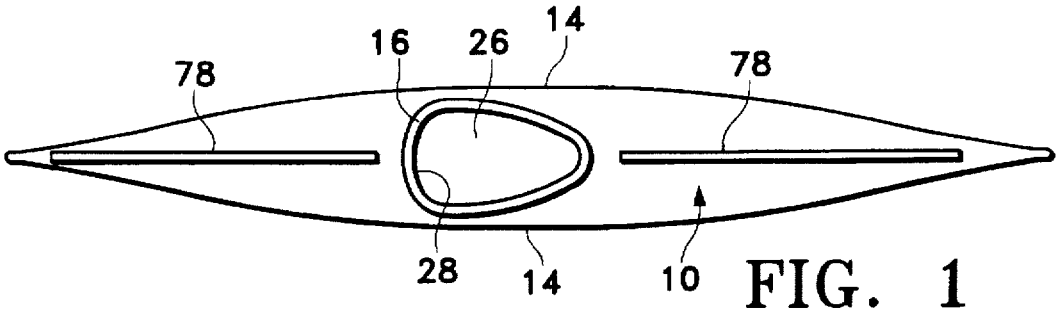
FIG. 1 is the top plan view of a kayak, being an illustrative embodiment of the invention.
Figure 2:
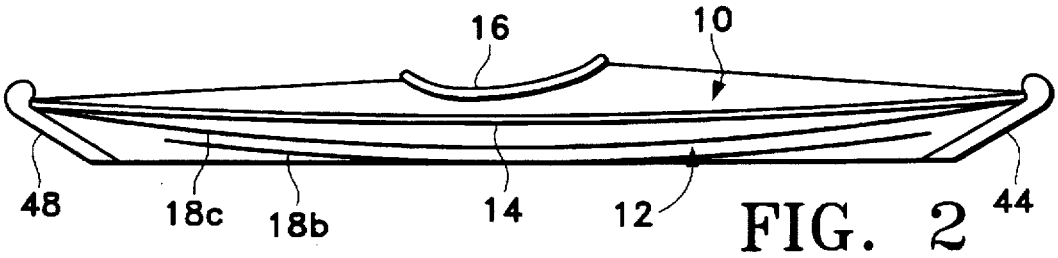
FIG. 2 is a lateral view of the kayak of FIG. 1.

The novel kayak in the drawings consists basically of a framework bearing semi-rigid sheet material. As shown in FIGS. 1 and 2, the kayak includes a deck 10 and a bull 12 united along lateral stem-to-stern joints 14. A coaming 16 forms an essentially rigid frame around an opening in the deck for the kayak's occupant. A seat 26 under coaming 16 and a seat back 28 are provided for the occupant.

Figure 3:
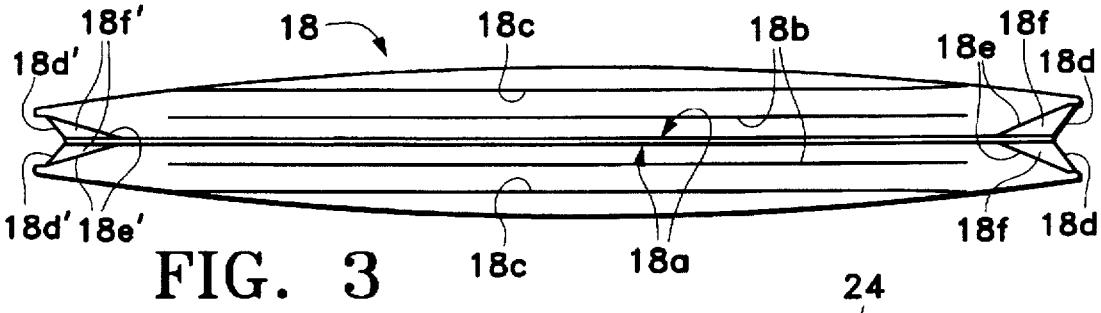
FIG. 3 shows a single flat piece of sheet material which is to constitute the hull wall of the kayak of FIGS. 1 and 2.
Figure 6:
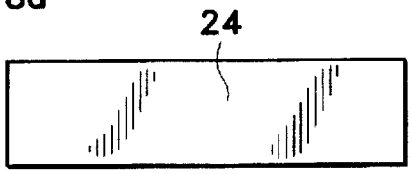
FIG. 6 shows a piece of sheet material that forms a liner on the hull's wall in the illustrative kayak.

The wall of hull 12 is formed of a single piece 18 of watertight, dimensionally stable sheet material (FIG. 3). (As expressed variously hereinafter, a piece of sheet material is sometimes called "a sheet".) The outline of this piece of sheet material, or sheet, is a pre-cut shape. Pairs of creases are formed in it, such that, shaping this sheet against the framework forms the wall of the hull, free of joints. The one-piece form of the hull's wall precludes below-water joints, where leaks could be critical.

Creases are formed in sheet 18 to promote the formation of the contours of the hull. One pair of creases 18*a* extend from end-to-end, centered between the longitudinal edges of the sheet, to constitute the outer keel of the kayak. Two pairs of parallel creases 18*b* and 18*c*, placed symmetrically at opposite sides of creases 18*a*, promote the formation of the hull's contour as seen in FIG. 2.

At opposite ends of sheet 18 there are V-shaped notches, defined by edges 18*d* and 18*d'*. Creases 18*e* and 18*e'* define pairs of triangular areas 18*f* and 18*f'*. In the course of assembling the kayak, the end portions of sheet 18 are folded and gathered. Edges 18*d* become side-by-side and the bottoms of areas 18*f* become face-to-face; edges 18*d'* and areas 18*f'* are gathered correspondingly.

Figure 4:
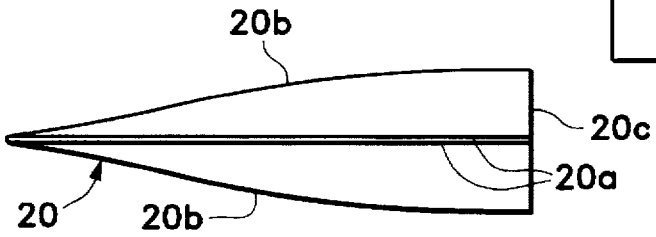
FIGS. 4 and 5 show two pieces of flat sheet material for constituting the deck wall of the kayak of FIGS. 1 and 2, these pieces of sheet material later being trimmed during assembly of the kayak.
Figure 5:
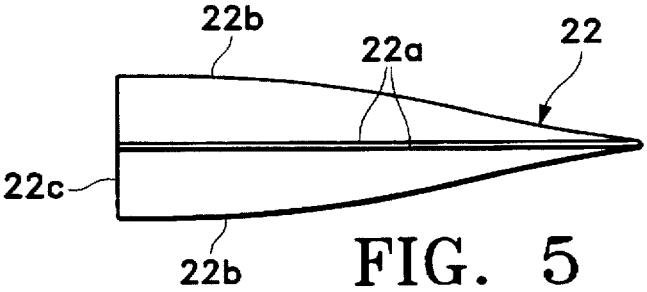

The wall of deck 10 is formed of two pieces 20 and 22 (FIGS. 4 and 5) of the same dimensionally stable watertight material as that of sheet 18. Each sheet 20 and 22 has a close-spaced pair of creases 20*a* and 22*a*. Longitudinal edges 20*b* and 22*b* are pre-cut accurately; end edges 20*c* and 22*c* need not be cut accurately because these edges are trimmed as the deck is formed during assembly operations, detailed below.

An additional piece of sheet material 24 is a "liner", to cover an area of the hull; its purpose will be explained below.

The pieces of sheet material 18, 20 and 22 ideally should combine a number of qualities. Of course, the material should be watertight. It should be dimensionally stable so that a piece of the material, when cut to shape, retains its shape after being fastened to the framework; the sheets and the framework, together, develop structural stability. Furthermore, the surface of the material as available ideally should be durable and attractive and suitable for exposure to marine conditions; no special surface treatment should be needed. The sheet material should be lightweight, and it should be buoyant; and, when applied to the kayak's framework, it should serve as a "hard skin", i.e., it should be semi-rigid and intrinsically it should exhibit stiffness where it extends across "formers" and between the formers (where it is not supported).

Figure 7:
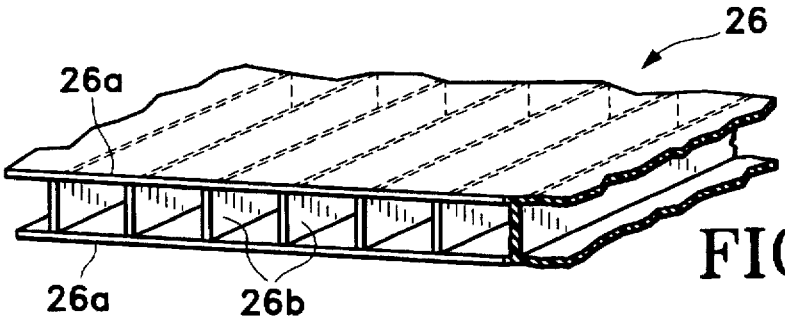
FIG. 7 is a greatly enlarged perspective of a fragment of the sheet material of FIGS. 3–6.

Sheet material that meets these criteria and still others is available commercially, as "Coroplast". This material (FIG. 7) comprises two plastic face sheets 26*a* that are unified by parallel separating walls 26*b* of the same plastic as the face sheets. Its surface is durable and resistant to marine conditions, and it is lightweight and buoyant. Commercially available compositions such as a silicone caulking sold by General Electric Corp. bonds to Coroplast, forming mechanical bonds and waterproof joints. And while Coroplast is supplied as large flat sheets, it is sufficiently pliant to be rolled up for compact packaging.

Figure 8:
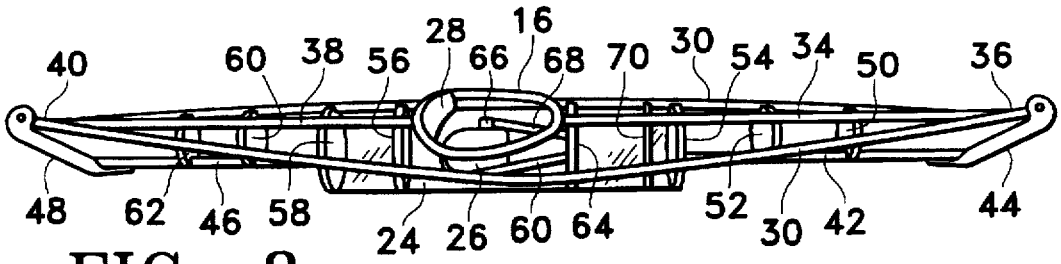
FIG. 8 is a perspective view of the framework of the kayak shown in FIGS. 1 and 2, as seen from one side and slightly above the framework.
Figure 9:
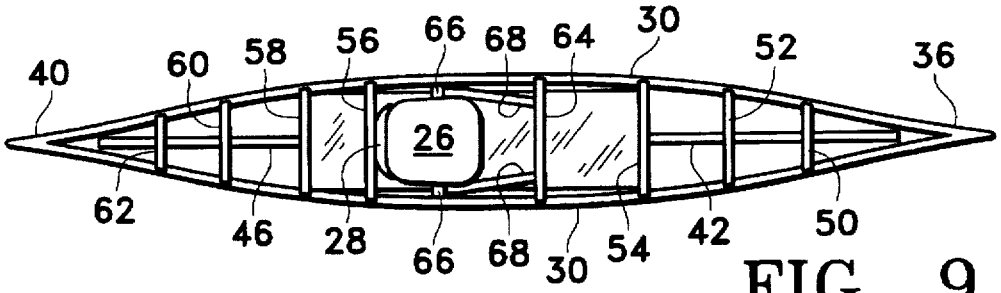
FIG. 9 is a top plan view of the framework shown in FIG. 8, omitting parts of the framework in the kavak's deck.
Figure 11:
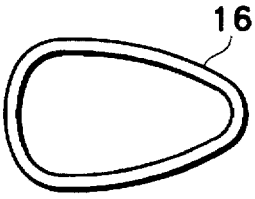
FIG. 11 is a top plan view of a component of FIG. 10, being the coaming of the kayak of FIGS. 1 and 2.
Figure 10:
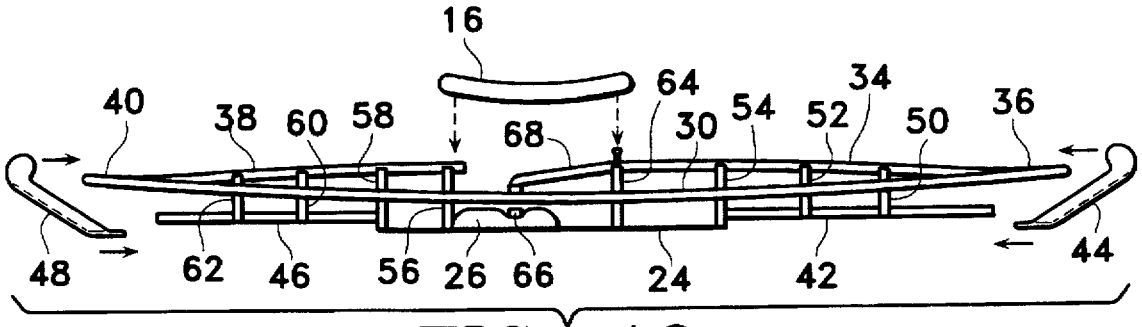
FIG. 10 is a side elevation of the framework of FIG. 8, showing a few components separated from the rest of the framework.
Figure 14:
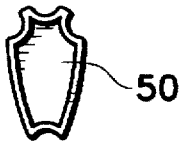
FIGS. 14–20 are front views of formers or frame members constituting components of the framework of FIGS. 8–10.
Figure 15:
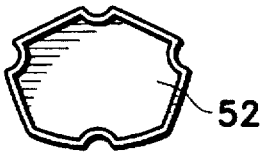
Figure 16:
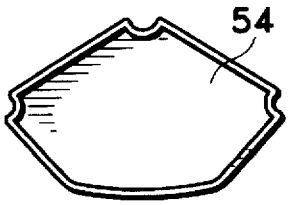

The complete framework of the kayak is shown in FIG. 8; even though the framework shown in this Figure does not exist alone in this form during assembly of the kayak, this image of the complete framework will be useful. FIG. 9 illustrates the framework, omitting the deck parts. FIG. 10 illustrates a portion of the framework that may be assembled in preparation for applying the hull wall and the deck wall. In FIG. 9, sheet 24 constitutes a bottom liner. Seat 26 is fixed to liner 24. Seat back 28 is supported suitably above and to the rear of seat 26.

At each side of the framework (FIG. 9) there is an elongated gunwale member 30 that extends from joint 36 to joint 40 at the opposite ends of the kayak.

Generally, egg-shaped coaming 16 forms a frame around the opening in the deck, being located above seat 26. The rear end of front deck brace 34 is fastened to a front portion of coaming 16; the front end of front deck brace 34 is fixed to gunwale members 30 adjacent to joint 36. Correspondingly, the front end of a rear deck brace 38 is fixed to a rear portion of coaming 16 and the rear end of the rear deck brace is fixed to gunwale members 30 adjacent to joint 40.

An elongated front inner keel member 42 has its rear end fixed to liner 24, while the front end of this inner keel member is fixed to bow stem 44; joint 36 is also united to bow stem 44. Elongated rear inner keel member 46 has its front end fixed to liner 24, while its rear end is united to stern stem 48.

A series of formers or transverse frames 50, 52, 54, 56, 58, 60 and 62 are screwed to each gunwale member 30 and to respective front and rear deck braces and to respective front and rear inner keel members. A cockpit brace 64 (FIG. 27) is also screwed to both gunwale members 30, to front deck brace 34 and to liner 24. Cockpit brace 64 resembles formers 50 . . . 62 except that the cockpit brace is an open frame, to accommodate the legs the kayak's occupant. Or course, all of the formers may also be open frames.

Figure 17:
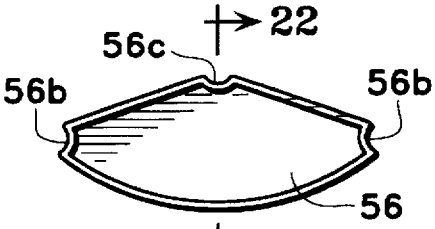
Figure 22:
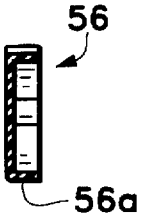
FIG. 22 is a cross-section of the former of FIG. 17 at the plane 22—22 in FIG. 17.

Formers 50 . . . 62 are shown in FIGS. 14–20. Each former in, in a sense, a frame that positions the greatly elongated members of the framework 30, 32, 34, 38, 42 and 46, for controlling the contours of the walls of the hull and the deck. Former 56 is typical (FIGS. 17 and 22). It consists of a generally flat sheet of plastic having an upstanding peripheral wall 50*a*. The peripheral wall 56*a* has two indentations 56*b* for receiving, and locating, the two gunwale members 30 and a third indentation 56*c* for deck brace 38. The lower margin of former 56 bears against liner 24 and, indirectly, against the bottom of the hull wall. Correspondingly, the desk wall bears on the upper margin of former 56. At each indentation 56*b*, a screw (not shown) extends outward through peripheral wall 56*a* and into the respective gunwale members 30; and a screw extends outward at indentation 56*c*, through wall 56*a* and into rear deck brace 38.

Figure 21:
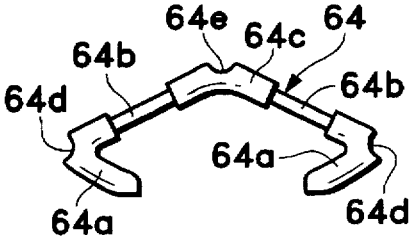
FIG. 21 is a front view of a cockpit brace, being a component of the framework of FIGS. 8–10.
Figure 18:
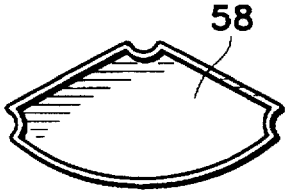
Figure 19:
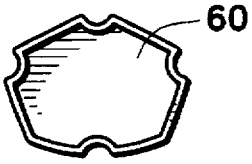
Figure 20:
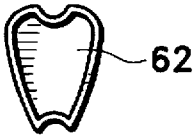

Cockpit brace 64 is shown in FIG. 21. This brace includes two brackets 64*a* (which are screwed to liner 24), two short lengths of pipe 64*b*, and a third bracket 64*c* that unites the two pipes 64*b*. The open-arch shape of cockpit brace 64 is to accommodate the legs of the kayak's occupant. The deck brace 64 is screwed to gunwale member 30 at indentations 64*d* and front deck brace 34 is screwed to cockpit brace 64 at indentation 64*e*.

FIGS. 9 and 10 show part of the framework in formative stages. Gunwale members 38 are bowed outward, and fixed together at joints 36 and 40. Seat 26 and cockpit brace 64 and former 56 are screwed to liner 24. The front end of rear inner keel member 46 is secured to the rear end of liner 24 with the upstanding wall of former 58 interposed between them. The rear end of front inner keel member 42 is sucked to the front end of liner 24 with the upstanding wall of former 54 interposed between them. Each of the gunwale members is screwed to each of the formers and to the cockpit brace. The inner keel members and the deck braces are screwed to respective formers that they engage. The deck braces are fixed to the gunwale members adjacent to joints 36 and 40.

Figure 12:
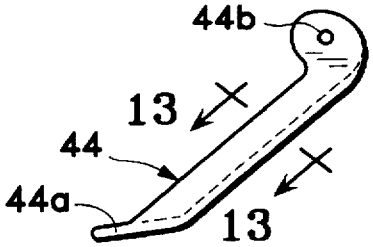
FIG. 12 is a side elevation of a forward stem, being a component of the framework of FIGS. 8–10, drawn to larger scale.
Figure 13:
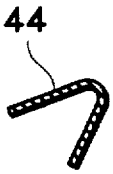
FIG. 13 is a cross-section of the stem of FIG. 12 as seen at the plane 13—13 in FIG. 12.

Bow stem 44 (FIG. 12) is channel-shaped along most of its length (see FIG. 13); it is flattened at its ends. The lower end 44*a* is flattened horizontally, to be fastened by screws to the front end of front inner keel member 42 after the wall of the hull has been secured to the framework. The upper end 44*b* provides a place for securing a meeting line. Stern stem 48 is essentially the same as bow stem 44.

Coaming 16 is shown in FIG. 10 separated from the rest of the kayak's framework because the coaming is not fixed to the rest of the framework until the deck wall is in place and has been fixed to the gunwale members as described below.

The kayak primarily comprises the framework and the sheets of material that form the walls of the deck and the hull. The kayak includes a few additional parts, e.g., the seat and the seat back, mentioned above. The kayak also includes a pair of thigh braces 68 at opposite sides of the cockpit. A pair of brackets 66 are fixed to seat 26 and to liner 24. These brackets provide suitable points for fastening the rear ends of the thigh braces; the front ends of the thigh braces are screwed to the cockpit brace at bracket 64*c*.

Further, a foot rest 70 (FIG. 8) is positioned forward of the cockpit brace, held adjustably in position by ropes extending rearward in guides (not shown) to accessible anchoring ends close to seat 26.

Still further, the kayak is equipped with a conventional spray shield (not shown) that forms a barrier against water entering the kayak at the space between the coaming and the body of the kayak's occupant. Along the periphery of the spray shield there is an elastic cord C that is captive in the recess that is formed where the coaming and the deck meet (.FIG. 33).

The kayak thus far described is remarkably sturdy, lightweight, attractive and durable; its parts are amenable to being compactly packaged so that it can be shipped and stored in inventory economically, without preempting a disproportionate amount of shipping or storage space. Remarkably serviceable full-size hard-skin kayaks, as described, are 16 feet long and weigh only 37 pounds.

Figure 23:
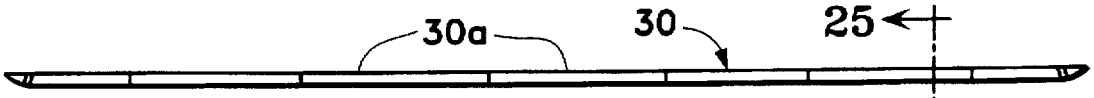
FIG. 23 is a lateral view of a component of the framework of FIGS. 8–10.
Figure 24:
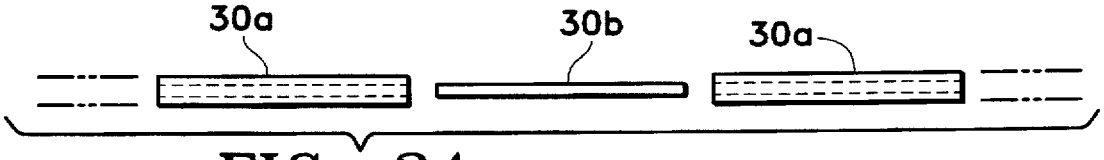
FIG. 24 is an exploded view of parts of the component of FIG. 23, drawn to larger scale.
Figure 25:
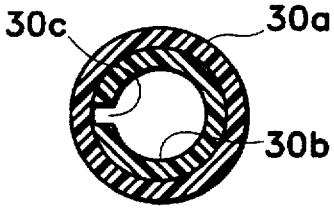
FIG. 25 is a cross-section of the component of FIG. 23 as seen at the plane 25—25 of FIG. 23, drawn to greatly enlarged scale.

Each gunwale member 30 is an assembly of a series of pipe lengths 30*a* (FIGS. 23 and 24) being (for example) commercial polyvinyl chloride cold-water pipe, plus elongated cores 30*b*. In the form shown here, these cores consist of lengths of pipe of slightly smaller pipe size than pipe lengths 30*a*. An arcuate segment is sawed out of the pipe lengths in forming cores 30*b*. Such cores can be squeezed enough to fit tightly in the bores of two endwise aligned (hence "paired") pipe lengths 30*a* and they maintain the pipe lengths securely in alignment.

Figure 29:
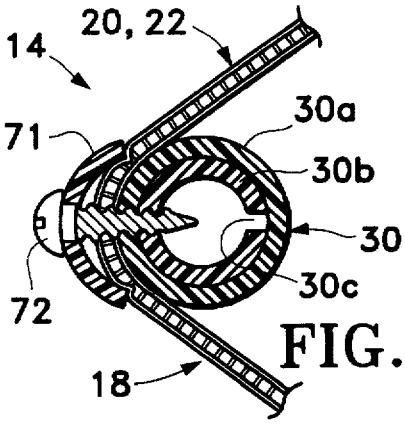
FIG. 29 is a cross-section of a fragment of the kayak of FIGS. 1 and 2, transverse to the length of the kayak, showing the junction of the gunwale member and the hull wall and the deck wall, drawn to larger scale.

Pipe lengths 30*a* provide only a limited wall thickness for screws to be retained securely; however, pipe lengths 30*a* and cores 30*b* combine their wall thicknesses for secure tightening of the screws (FIG. 29). The combined length of cores 30*b* is essentially equal to the combined length of pipe lengths 30*a*. In this way, assurance is provided that double wall thickness will be present regardless of where, along a gunwale member 30, one might choose to drive a screw. Gap 30*c* of Core 30*b* should be so positioned that there is no likelihood of a screw entering such gap. The telescopic assembly of the cores and the pipe lengths results in a strong greatly elongated member of the kayak's framework.

What has been said of gunwale members 30, formed of end-wise aligned lengths of pipe and cores for maintaining their alignment, applies also to deck braces 34 and 38 and to inner keel members 42 and 46. Those members are normally too long for compact packaging. However, when each member 34, 38, 42 and 46 is made of two pipe lengths and one length of core, those individual pipe lengths and their cores can be made short enough for compact packaging. It is not necessary for the cores of these members to occupy the entire length of the bores in their pipe lengths.

Figure 26:
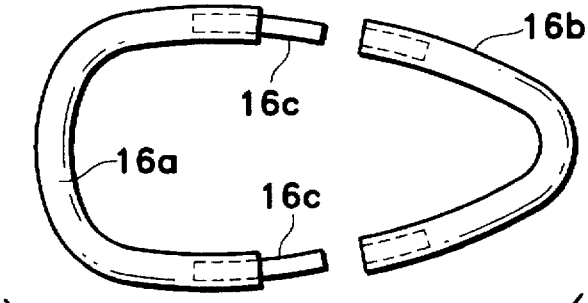
FIG. 26 is a view of the coaming of FIG. 11 in partly disassembled condition, drawn to larger scale.
Figure 33:
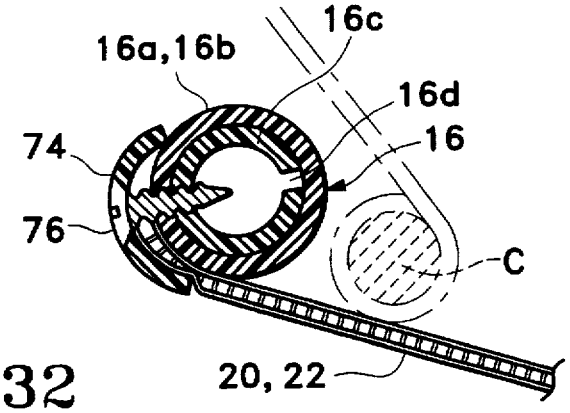
FIG. 33 is a fragmentary cross-section of a portion of the kayak of FIGS. 1 and 2, as seen at the plane 32—32 of FIG. 31, following completion of the assembly operations.

As seen in FIG. 26, the coaming is divided into two parts 16*a* and 16*b*. Each part is a length of PVC pipe that has been heat-softened and molded to the proper shape. Both parts are made of the same size of pipe. Cores 16*c* are optimally made of PVC pipe whose outer diameter is a bit larger than the bores of parts 16*a* and 16*b* and then sawed longitudinally to develop a gap 16*d* (FIG. 33). Cores 16*c* fit tightly into the bores of coaming parts 16*a* and 16*b*. Those parts are in endwise aligned abutment when assembled, using cores 16*c*.

The parts of the illustrative kayak thus far described can be compactly packaged for economical shipment and for storage in inventory, so as to be immediately available for sale "over the counter" and delivery. The long pieces of sheet material 18, 20 and 22 that are to constitute the walls of the deck and the hull, plus liner 24, are rolled-up. Together, they form a single coil whose axial length is the width of those pieces of sheet material. Despite the stiffness of the sheet material that results in the hard-skin kayak, that material is sufficiently pliable to be rolled up for packaging. The elongated members of the framework can be packaged compactly before their parts are telescopically assembled. All of the described parts of the illustrative 16-foot kayak can readily be contained in a single carton 18 inches by 18 inches by 32 inches.

Only simple tools and little skill are needed in assembling the parts of the kayak of FIGS. 1 and 2.

In a first phase, the framework shown in FIG. 10 may be assembled, omitting coaming 16 and the prow and stern stems 44 and 48. The parts of gunwale members 30 (FIG. 23) may first be assembled, such that half of the length of each core 30*b* extends into the bores of that pair of pipe lengths 30*a* to be held in endwise alignment by that core. Joints 36 and 40 may be made, uniting the gunwale members 30 at their ends. Seat 26 and former 56 and cockpit brace 68 may be fastened to liner 24.

The two pipe lengths and one core of each inner keel member are telescopically assembled. Holes may be drilled in those keel members at each place where another part is to be fastened. One end of each inner keel member 42 and 46 may be fastened to a respective end of liner 24. The liner may also be fastened to formers 54, 56 and 58, and formers 50, 52, 60 and 62 may be fastened to the inner keel members. The gunwale members 30 may then be fastened to each of the formers. At most places where an elongated member of the framework is to be fastened to a former, an indentation is provided for locating that member and for recessing that member into the outline of the former. For example, two indentations 56*b* have been provided in former 56. Holes are drilled through each gunwale member where a former is to be located. Then, with former 56 (for example) in place, the pre-drilled holes in members 30 are extended through the upstanding wall 56*a* at each of the indentations 56*b*. Screws are driven outward through wall 56*a* and into the member 30. This is repeated to fasten each gunwale member to each former, and to the cockpit brace.

The parts of the deck braces may then be assembled telescopically. One end of each brace may then be fixed to the gunwale members closely adjacent to a respective fore or aft joint 36, 40, and the various formers and cockpit brace 64 may then be screwed to the deck braces at the prepared indentations in the manner described in connection with the formers and members 30 For example, deck brace 38 and former 56 are screwed together at indentation 56*c*.

When the framework has been assembled thus far, it may be placed on sheet 18 (FIG. 3). Sheet 18 may be worked upward against the framework. In doing so, the end portions of sheet 18 are folded and gathered as described previously. The longitudinal edges of sheet 18 are pre-cut accurately; when sheet 18 is assembled to the framework, those edges are disposed opposite to the midpoint (vertically) of each gunwale member.

Figure 27:
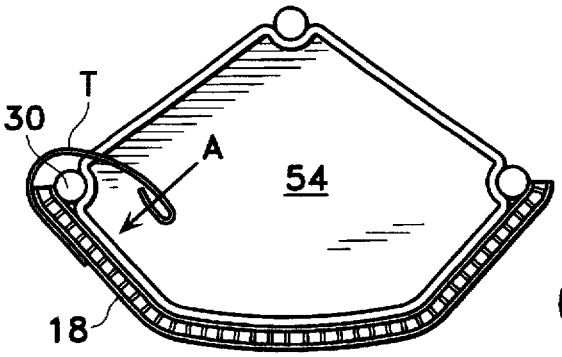
FIGS. 27 and 28 are somewhat diagrammatic transverse cross-sections of the kayak of FIGS. 1 and 2, representing two stages of the assembly operations.
Figure 28:
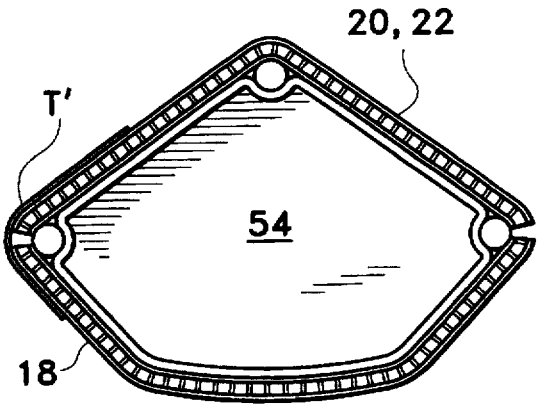

Strips T of tacky adhesive tape are helpful in holding the edges of sheet 18 against the gunwale members. A strip of tape T may be adhered to sheet 18 near one longitudinal margin (FIG. 27). Then, while sheet 18 is held in place locally, the tape may be pulled taut over member 30 and moved (arrow A) against the inside surface of the hull wall. Repeating this exercise at space intervals along one margin of sheet 18 and then along the other margin, brings the hull wall into proper temporary assembly with the framework. One sheet 20 and then the other sheet 22 is placed on the framework with its longitudinal edges at each of the gunwale members 30 close to the edges of sheet 18. Strips of tape T' are applied to the hull and deck sheets along one gunwale member 30 as shown in FIG. 28. This holds the walls of the deck and the hull at one side of the assembly in place temporarily. Strips of tape T are advantageously removed in sequence as strips T' are applied.

Before the second longitudinal margin of sheet 20 or 22 is taped in place, it may be useful to bond sheet 20 to forward deck brace 34. This may be done by applying bonding composition such as C.E. Silicone to the deck brace and the deck sheet where they are in contact. This procedure is repeated for bonding sheet 22 to deck brace 39. Secure bonds are formed between sheets 20 and 22 and dock braces 34 and 38, respectively, where (as here) the materials are appropriate.

G.E. Silicone caulking composition bonds strongly to Coroplast, which is extruded polyethylene, and to the deck braces which are polyvinyl chloride pipes, in the present example. After the bonding composition hue been applied, the second longitudinal margin of sheet 20, 22 may be taped in place at gunwale member 30, as before. The longitudinal edges of sheets 20, 22 are accurately pre-cut to be close to the longitudinal edges of the hull wall 18.

Figure 30:
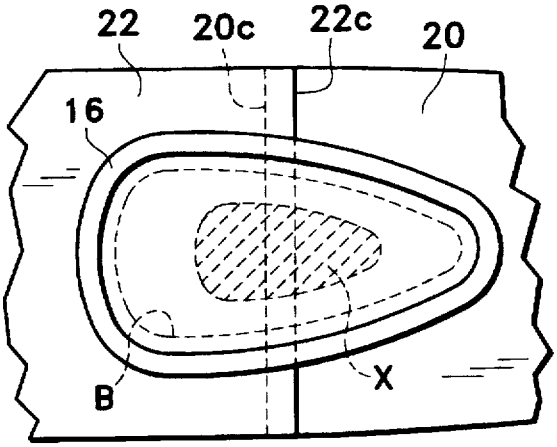
FIGS. 30 and 31 are fragmentary top plan views of the kayak of FIGS. 1 and 2, representing certain assembly operations.

End margins 20*c* and 22*c* may well overlap at this point (FIG. 30). The edge of one sheet may then be used as a guide for a knife to cut the other sheet, so as to develop edge-to-edge abutment. Those edges may be unified by a waterproof bonding composition, such as G.E. Silicone caulking. This edge-to-edge joint is advantageously enhanced by some form of splicing trim (not shown).

Wherever the cut edges of the Coroplast have the ends of their hollows (FIG. 7) exposed, covering those ends with suitable caulking will guard against water filling those hollows.

When the deck sheets have been trimmed and taped in place, a clamping strip 71 may be applied to marginal portions of both sheet 18 and a sheet 20 or 22 (FIG. 29). Clamping strip or cap 71 in exemplary form is a greatly elongated segment of a pipe of the same pipe size as pipe lengths 30*a*. As such, the inner surface of the clamping strip has a smaller radius than the outer radius of pipe length 30*a*; it is arched away from pipe length 30*a*. Stated otherwise, the margin of the clamping strip 71 are closer to the surface of pipe length 30*a* than the centerlinc of strip 71 relative to the pipe surface.

Cap 71 may be a continuous strip all along each gunwale member 30, or multiple lengths of the car strip may be used along each clamping or gunwale member 30. Before each cap strip is put in place, it is desirable to apply a generous bead of waterproof bonding composition to the concave or inner surface of the clamping strips. Screws 72 are driven through each clamping strip and into both of a pipe length 30*a* and the contained core 30*b*. As the screws are being driven in succession into the gunwale members, the tapes T' are removed sequentially (before the clamping strip been tightened against any particular tape T'). After the strips of tape T' have been removed, the screw are tightened. This drives the margins of each clamping strip 71; thereby indenting the underlying marginal portions of hull sheet 19 and of deck sheet 20 or 22. The previously applied bonding composition is forced into the space between the edges of the sheets under each clamping strip, for excluding water and for enhancing the mechanical stability of the joint along each gunwale member.

Figure 31:
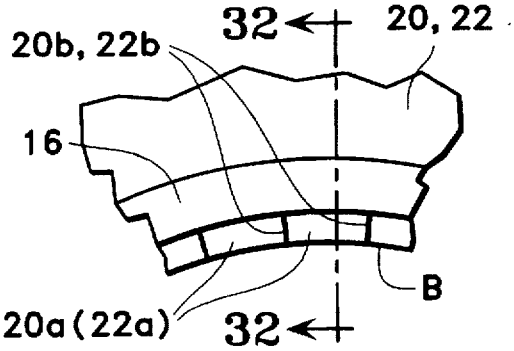
Figure 32:
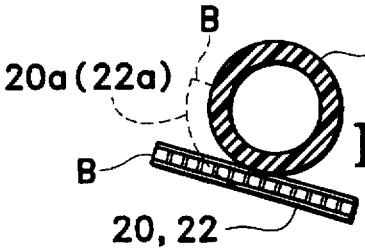
FIG. 32 is a fragmentary cross-section of components shown in FIG. 31, as viewed at the plane 32—32 in FIG. 31 and drawn to much larger scale.

Referring to FIG. 30, the shaded area x of sheets 20 end 22 may be cut away, to allow hand access to the interior. By feel, forward and rear portions of coaming 16 may be positioned over respective rear and forward ends of the respective deck braces 34 and 38, adjacent to formers 56 and 64. The coaming is then screwed to the deck braces. Sheets 20 and 22 are then cut along line B (FIG. 30) which is spaced a short distance inward from the coaming. Short slits 20*b* and 22*b* (FIG. 31) are cut into sheets 20 and 22 inside the coaming, for dividing the margins of sheets 20 and 22 into segments that may be curved up against the coaming 16 as represented in broken lines in FIG. 31. These segments may be held in their curved position temporarily by adhesive tapes (not shown). Clamping strip 74 (FIG. 33) is then placed over the curved marginal portion of sheet 20, and of sheet 22; but before the clamping strip is applied, a generous bead of waterproof bonding composition may be applied to its inner surface. Screws 76 may be driven through the clamping strip and into the pipe that forms coaming 16, and into cores 16*c* where the coaming pipe contains the cores. The screws are not tightened until the temporary tapes have been removed; then the screws are tightened. The bonding composition forms a seal that assures exclusion of water from the edges of sheets 20, 22 and it mechanically unifies the clamping strip and sheets 20, 22 and the coaming. It may be convenient to subdivide clamping strip 74 into two or more lengths.

At each end of the hull, each stem 44 and 48 is heavily loaded with waterproof bonding composition. Then, with each end of hull wall 18 gathered (as described above), each stem is pushed into place; the upper end of each stem forms a pocket which receives a fore or aft joint of the gunwale members 30 and the ends of caps 71. The gathered end margins of hull wall 18 are also received in the stem, from the top pocket and along most of the length of each stem. The lowermost end of the stem, which has been flattened, is screwed to the hull i.e., through the hull's wall and into an inner keel member 42, 46.

As a preferred alternative to bonding the desk sheets to the deck braces, as described above, wear stripe 78 (FIG. 1) may be applied to the exterior of deck sheets 20 and 22 along the deck braces, then screwed to the deck braces. The wear strips serve to unify the deck sheets and the deck braces, additionally providing protection for the kayak when strapped to a roof rack of an automobile.

The foregoing represents the presently preferred form of a kayak, and assembly procedures, exemplifying various aspects of the invention. However, it is self-evident that alternatives and modifications will be readily apparent to those skilled in the art. Consequently, the invention should be construed broadly in, accordance with its true spirit and scope.

I claim:

1. A kayak including a framework having multiple greatly elongated members, two of which are gunwale members whose respective extremities are united at fore and aft ends of the kayak, pieces of dimensionally stable watertight sheet material constituting the hull wall of the kayak and constituting the deck wall of the kayak, said hull wall having hull marginal portions extending along said gunwale members, respectively, and said deck wall having deck marginal portions extending along said gunwale members, respectively, and means for securing said deck marginal portions and said hull marginal portions to said gunwale members, said hull wall consisting essentially of a single joint-free piece of said sheet material, folded and gathered at the fore and aft ends of the kayak.

2. A kayak including a framework having multiple greatly elongated members, two of which are gunwale members whose respective extremities are united at fore and aft ends of the kayak, pieces of dimensionally stable watertight sheet material constituting the hull wall of the kayak and constituting the deck wall of the kayak, said hull wall having hull marginal portions extending along said gunwale members, respectively, and said deck wall having deck marginal portions extending along said gunwale members, respectively, and means for securing said deck marginal portions and said hull marginal portions to said gunwale members, each of said gunwale members comprising an end-to-end succession of pipe lengths of one pipe size having end-to-end bores and, for each end-to-end pair of said succession of pipe lengths, a core extending tightly into the bores of both of said pair of pipe lengths.

3. A kit of components for producing the kayak of claim 2, packaged for shipment or storage in inventory, wherein the longest package dimension is much smaller than the length of the kayak and wherein said pieces of sheet material are rolled up.

4. A kayak as in claim 2, wherein the lengths of the cores collectively occupy the length of the bores of said pipe lengths.

5. A kayak as in claim 4, wherein said means for securing includes clamping strips each of which overlies marginal portions of a deck wall and a hull wall along a said gunwale member, and fasteners extending through each clamping strip and into a said pipe length and the core therein, the fasteners thus arresting the pipes and cores against shifting lengthwise relative to each other.

6. A kayak as in claim 2, wherein each core is a piece of pipe whose outer diameter is greater than the bore diameter of said lengths of pipe, an arcuate segment of said piece of pipe being cut away to leave a narrow longitudinal gap, each core being squeezed to reduce such gap when being inserted into said end-to-end aligned pipe lengths.

7. A kayak including a framework having multiple greatly elongated members, two of which are gunwale members, fore and aft joints uniting respective extremities of said gunwale members, pieces of dimensionally stable watertight sheet material constituting the hull wall of the kayak and constituting the deck wall of the kayak, said hull wall having hull marginal portions extending all along said gunwale members, respectively, and said deck wall having deck marginal portions extending all along said gunwale members, respectively, and means for securing said deck marginal portions and said hull marginal portions to said gunwale members, said greatly elongated members including front and rear deck braces, each of said deck braces having an extremity that is fixed to a respective one of said fore and aft joints of said gunwale members, said framework further including front transverse frames at spaced-apart locations along said front deck brace and rear transverse frames at spaced-apart locations along said rear deck brace, each of said transverse frames being fixed to said gunwale members and to a respective one of said deck braces, said framework thereby including a forward truss comprising said front transverse frames and the greatly elongated members fixed thereto and said framework also including an aft truss comprising said rear transverse frames and the greatly elongated members fixed thereto.

8. A kayak as in claim 7, further including a coaming unified with said deck wall, fore and aft portions of the coaming being secured to rear and front extremities, respectively, of said front and rear deck braces so that said coaming is interposed between said fore and aft trusses, said coaming and said deck braces forming a serially connected structure extending between said forward and aft joints, said serially connected structure providing compressive strength for withstanding compressive force along the deck resulting from flotation of the kayak.

9. A kayak as in claim 8, wherein each of said deck braces and peripheral portions of said transverse frames and the periphery of said coaming are secured to said deck wall, whereby the structural integrity of said serially connected structure is enhanced by the dimensional stability of the sheet material of the deck wall.

10. A kayak including a framework having multiple greatly elongated members, two of which are gunwale members whose respective extremities are united to form fore and aft joints, pieces of dimensionally stable watertight sheet material constituting the hull wall of the kayak and constituting the deck wall of the kayak, said hull wall having hull marginal portions extending along said gunwale members, respectively, and said deck wall having deck marginal portions extending along said gunwale members, respectively, and means for securing said deck marginal portions and said hull marginal portions to said gunwale members, said framework further including elongated prow and stern stems each having first and second ends, said first ends of said stems being fixed to said fore and aft joints, respectively, further including an elongated liner supported by said hull wall, bearing a seat for the kayak's occupant, and said framework further including a pair of greatly elongated inner keel members extending from a respective end of said liner to respective second ends of said stems so that said stems and said inner keel members and said liner constitute a serially connected structure which provides structural strength to withstand tension developed along the bottom of the kayak resulting from flotation of the kayak.

11. A kayak having a framework including a pair of gunwale members extending along the sides of the kayak, said kayak having a deck wall and a hull wall of dimensionally stable watertight sheet material, each of said walls having marginal portions extending along and against said gunwale members, said marginal portions of said deck wall and of said hull wall at each gunwale member having mutually opposite edges, and clamping strips extending along said gunwale members, respective marginal portions of each clamping strip separately overlying a said marginal hull wall portion and a said marginal deck wall portion, and fasteners tightened against said clamping strips and extending into the gunwale members between mutually opposite edges of said marginal portions of the deck wall and the hull wall, said tightened fasteners driving the respective marginal portions of each clamping strip forcefully against the underlying marginal portions of the deck wall and the hull wall.

12. A kayak as in claim 11, wherein each said gunwale member comprises plastic pipe and wherein each said clamping strip is a greatly elongated segment of a plastic pipe of the same pipe size as the pipe of the underlying gunwale member, each said clamping strip having a concave side that forcefully engages the marginal portions of the deck wall and the hull wall.

13. A kayak as in claim 11, wherein said pieces of sheet material are of plastic containing air cells and are compressible, said clamping strips having spaced-apart rib-like formations forced by said fasteners to become impressed into said compressible marginal portions of the deck wall and the hull wall and thereby to establish enhanced grip of said marginal portions.

14. A kayak as in claim 11, wherein said sheet material is prominently compressible and wherein said marginal portions of said clamping strips are forced by said fastening means to compress and indent respective underlying marginal portions of the deck wall and the hull wall.

15. A kayak including a framework having multiple greatly elongated members, two of which are gunwale members whose respective extremities are united at fore and aft ends of the kayak, pieces of dimensionally stable watertight sheet material constituting the hull wall of the kayak and constituting the deck wall of the kayak, said hull wall having hull marginal portions extending along said gunwale members, respectively, and said deck wall having deck marginal portions extending along said gunwale members, respectively, and means for securing said deck marginal portions and said hull marginal portions to said gunwale members, further including a rigid egg-shaped coaming and wherein said deck wall has a second marginal portion that is disposed against the inner surface of the egg-shaped coaming, and second securing means for securing said second marginal portion of the deck wall to said coaming, said coaming being related to said deck wall so as to define a peripheral recess for receiving a retaining cord of a spray shield.

16. A kayak as in claim 15, wherein said coaming is formed largely of plastic pipe, and wherein said second securing means includes one or more clamping strips extending along and overlying said second marginal portion of the deck wall and fasteners for causing said second marginal portion of the deck wall to be gripped between a said clamping strip and said plastic pipe.

17. A kayak as in claim 16, wherein each of said one or more clamping strips is an elongated segment of a pipe of the same pipe size as the plastic pipe of the coaming.

18. A kayak including a framework having multiple greatly elongated members, two of which are gunwale members, fore and aft joints uniting respective extremities of said gunwale members, pieces of dimensionally stable watertight sheet material constituting the hull wall of the kayak and constitituting the deck wall of the kayak, said hull wall having hull marginal portions extending all along said gunwale members, respectively, and said deck wall having deck marginal portions extending all along said gunwale members, respectively, and means for securing said deck marginal portions and said hull marginal portions to said gunwale members, further including an egg-shaped coaming having forward and rear portions, said framework including a greatly elongated forward deck brace whose extremities are fixed, respectively, to said fore joint of the gunwale members and to said forward portion of said coaming, and a greatly elongated rear deck brace whose extremities are fixed, respectively, to said aft joint of the gunwale members and said rear portion of the coaming, whereby said forward and rear deck braces and said coaming form a serially connected portion of said framework that provides compressive strength for withstanding a compressive force that develops along the deck that results from floatation of the kayak.

19. A kayak including a framework having multiple greatly elongated members, two of which are gunwale members whose respective extremities are united at fore and aft ends of the kayak, pieces of dimensionally stable watertight sheet material constituting the hull wall of the kayak and constituting the deck wall of the kayak, said hull wall having hull marginal portions extending along said gunwale members, respectively, and said deck wall having deck marginal portions extending along said gunwale members, respectively, and means for securing said deck marginal portions and said hull marginal portions to said gunwale members, said dimensionally stable sheet material comprising mutually spaced-apart watertight facing sheets of plastic unified by numerous parallel separating walls of the same plastic as said facing sheets so as to constitute numerous elongated parallel floatation-promoting hollows, said separating walls and the facing sheets and the separation of the facing sheets from each other imparting bend resistance to said sheet material.

20. A kayak as in claim 19, wherein, said framework includes a succession of spaced-apart frees transverse to said gunwale members, the sheet material being disposed such that said separating walls extend across said frees, whereby the sheet material, due to its structure, exhibits stiffness across each frame and between successive frames.

21. A kayak having a hull and a deck and a generally egg-shaped coaming in the deck for accommodating an occupant, said kayak including A) A framework including i. a pair of greatly elongated gunwale members extending to and being unified by fore and aft joints, said gunwale members forming a demarkation between said deck and said hull, ii. said framework further including greatly elongated fore and aft deck braces each having an extremity secured to a respective one of said fore or aft joints and said front and rear deck braces each having another extremity secured to respective front and rear portions of said coaming, iii. said framework still further including a series structure comprising a liner of sheet material bearing a seat under said coaming, and elongated front and rear greatly elongated inner keel members having respective rear and front extremities secured to respective extremities of said liner, and elongated fore and aft stems each having one end secured to a respective one of said fore and aft joints and each stem having another end secured to a respective one of the front and rear extremities of said inner keel members, and iv. said framework further including a series of mutually spaced-apart formers disposed transverse to and joined to respective ones of said inner keel members and to both of said gunwale members and to respective ones of said deck braces, and B) said kayak having pieces of dimensionally stable, stiff and watertight sheet material forming the walls of the deck and the hull, i. the sheet material that forms the wall of said hull having hull marginal portions extending along said gunwale members, and ii. the sheet material that forms the wall of the deck having first deck marginal portions extending along said gunwale members at least close to said hull marginal portions and said deck sheet material having a second marginal portion bearing against an inner surface of the coaming essentially all around its egg shape, iii. means for securing said marginal hull portion and said first marginal deck portion of the sheet material of the hull and the deck to said gunwale members and further means for securing said second marginal portion of the deck sheet material to the coaming, whereby the sheet material that forms said deck wall and the sheet material that forms said hull wall coact with said framework to impart structural stability to the kayak.

22. A compactly packaged kit of components for producing the kayak of claim 21, wherein each of said greatly elongated members, when assembled, comprises a succession of endwise aligned and thus paired pipe lengths and respective elongated cores for extending into and maintaining alignment of paired pipe lengths, the pieces of sheet material generally being shaped as required in the assembled kayak but being rolled up, as packaged.

23. A compactly packaged kit of components as in claim 22, wherein said pieces of dimensionally stable sheet material are of plastic, having spaced-apart watertight facing sheets unified by elongated parallel separating walls so as to constitute greatly elongated hollows, the elongated separating walls being curved in the rolled-up condition of the pieces of sheet material.

* * * * *